US006556944B2

(12) United States Patent
Miyamoto

(10) Patent No.: US 6,556,944 B2
(45) Date of Patent: Apr. 29, 2003

(54) METHOD OF ANALYZING PHYSICAL PROPERTY OF GOLF BALL AND METHOD OF MANUFACTURING GOLF BALL

(75) Inventor: Kazuyoshi Miyamoto, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/912,375

(22) Filed: Jul. 26, 2001

(65) Prior Publication Data

US 2002/0023508 A1 Feb. 28, 2002

(30) Foreign Application Priority Data

Aug. 10, 2000 (JP) ..... 2000-242338

(51) Int. Cl.[7] ..... G06F 15/00
(52) U.S. Cl. ..... 702/155; 702/150
(58) Field of Search ..... 702/155, 150, 702/50, 97; 345/420, 423; 364/578; 703/212; 473/330, 199, 318, 321; 228/157

(56) References Cited

U.S. PATENT DOCUMENTS 5,731,817 A * 3/1998 Hahs et al. ..... 345/420

* cited by examiner

*Primary Examiner*—John Barlow
*Assistant Examiner*—Tung S Lau
(74) *Attorney, Agent, or Firm*—Birch, Stewart, Kolasch & Birch, LLP

(57) ABSTRACT

A ⅛ model is obtained at the steps of (A1) assuming a small cube, (A2) dividing the small cube into meshes, thereby obtaining a nodal point, (A3) projecting the nodal point included in each of three surfaces of the small cube which is not coincident with three planes of a ⅛ sphere onto a spherical surface of a small ⅛ sphere, thereby obtaining a new nodal point, (A4) dividing a space between the spherical surface of the small ⅛ sphere and that of the ⅛ sphere through spherical surfaces of a plurality of intermediate ⅛ spheres setting origins to be centers thereof, and (A5) sequentially repeating an operation for projecting a nodal point present on an inner spherical surface onto a spherical surface adjacent to an outside thereof from the small ⅛ sphere to the ⅛ sphere through the intermediate ⅛ spheres. The ⅛ model is expanded to obtain a finite element golf ball model.

4 Claims, 15 Drawing Sheets

METHOD OF ANALYZING PHYSICAL PROPERTY OF GOLF BALL AND METHOD OF MANUFACTURING GOLF BALL

BACKGROUND OF THE INVENTION

1. Field of the Invention

The present invention relates to a method of analyzing a physical property of a golf ball, and more particularly to an analyzing method using a finite element method.

2. Description of the Related Art

A golf ball is hit with a golf club and thus flies. A physical property during hitting such as a resilience characteristic, a launch direction, a spin rate or a hitting feeling greatly influences a subsequent trajectory (a trajectory height or a flight distance). A golf player is very interested in the trajectory (particularly, the flight distance). Therefore, a golf ball manufacturer has aimed at obtaining an improvement in the physical property during hitting and has made an effort toward development.

In the development of the golf ball, first of all, a design is carried out and a trial product is then fabricated. The trial product is subjected to a hitting test and a trajectory is measured together with the physical property during hitting. Data thus obtained by the measurement are decided. If the obtained result is insufficient, the data are fed back to a next design. In the development of the golf ball, thus, the design, the trial production and the hitting test are repeated, which takes a great deal of labor and time.

In place of the hitting test or together with the hitting test, the physical property is measured in the room. Examples of the physical property which can be measured in the room include a resilience coefficient, an amount of compressive deformation (so-called compression), a specific frequency, an impact force and the like. The physical property can be measured more easily in the room than the hitting test. However, the measurement of the physical property in the room is the same as the hitting test in that the trial product is to be fabricated. Thus, it takes a great deal of labor and time to develop the golf ball.

Furthermore, only the data on the physical property of the whole golf ball can be obtained by any of the hitting test and the measurement of the physical property in the room. Accordingly, it is hard to grasp a behavior presented by each portion of the golf ball during impact or compressive deformation. For this reason, trial and error are often repeated from a design to an evaluation in the development of the golf ball.

There has also been proposed a method of carrying out a simulation utilizing a finite element method or the like, thereby evaluating a golf ball without performing trial production. In the finite element method, an analyzing object (a golf ball) is divided into a large number of meshed elements.

However, since the golf ball is a sphere, a complicated operation is required for mesh formation. In particular, it is necessary to devise the mesh formation in order to analyze the golf ball with high precision.

In consideration of such circumstances, it is an object of the present invention to provide a method of analyzing a physical property of a golf ball using a finite element method based on useful mesh formation.

SUMMARY OF THE INVENTION

In order to achieve the above-mentioned object, the present invention provides a method of analyzing a physical property of a golf ball comprising the steps of:

(A) dividing, into eight equal portions, the golf ball having a center thereof positioned on an origin of three planes orthogonal to each other at the origin and dividing a ⅛ sphere thus obtained into a large number of meshed elements, thereby obtaining a ⅛ model;

(B) combining the ⅛ model obtained at the step (A), thereby obtaining a finite element golf ball model having an almost spherical shape, an almost semi-spherical shape or an almost ¼ spherical shape; and (C) analyzing the physical property of the golf ball through a finite element method using the finite element golf ball model obtained at the step (B).

The step (A) includes the steps of:

(A1) assuming a small cube in which one apex is coincident with an origin and three of six surfaces are coincident with three planes of the ⅛ sphere, respectively;

(A2) dividing the small cube into meshes, thereby obtaining a nodal point;

(A3) projecting the nodal point included in each of the three surfaces of the small cube which is not coincident with the three planes of the ⅛ sphere onto a spherical surface of a small ⅛ sphere including a small cube and setting an origin to be a center thereof, thereby obtaining a new nodal point;

(A4) dividing as pace between the spherical surface of the small ⅛ sphere and that of the ⅛ sphere through spherical surfaces of a plurality of intermediate ⅛ spheres setting origins to be centers thereof; and (A5) sequentially repeating an operation for projecting a nodal point present on an inner spherical surface onto a spherical surface adjacent to an outside thereof from the small ⅛ sphere to the ⅛ sphere through the intermediate ⅛ spheres.

In order to achieve the above-mentioned object, another invention provides a method of analyzing a physical property of a golf ball comprising the steps of:

(D) dividing the golf ball into a large number of meshed elements, thereby obtaining a finite element golf ball model having an almost spherical shape; and (E) analyzing the physical property of the golf ball through a finite element method using the finite element golf ball model obtained at the step (D).

The step (D) includes the steps of:

(D1) assuming a small cube positioned on a center of the golf ball;

(D2) dividing the small cube into meshes, thereby obtaining a nodal point;

(D3) projecting a nodal point on a surface of the small cube onto a spherical surface of a small sphere including a small cube and having a center thereof coincident with a center of the golf ball, thereby obtaining a new nodal point;

(D4) dividing a space between the spherical surface of the small sphere and that of the golf ball through spherical surfaces of a plurality of intermediate spheres having centers thereof coincident with the center of the golf ball; and (D5) sequentially repeating an operation for projecting a nodal point present on an inner spherical surface onto a spherical surface adjacent to an outside thereof from the small sphere to the spherical surface of the golf ball through the intermediate spheres.

In order to achieve the above-mentioned object, a further invention provides a method of analyzing a physical property of a golf ball comprising the steps of:

(F) dividing the golf ball into a large number of meshed elements, thereby obtaining a finite element golf ball model having an almost spherical shape, an almost semispherical shape or an almost ¼ spherical shape; and (G) analyzing the physical property of the golf ball through a finite element method using the finite element golf ball model obtained at the step (F).

The step (F) includes the steps of:

(F1) assuming a semicircle having a diameter almost equal to a diameter of the golf ball;

(F2) assuming a plurality of radial lines extended from a center of the semicircle toward an arc of the semicircle and a plurality of semicircular arcs which are concentric with the semicircle and have smaller diameters than a diameter of the semicircle;

(F3) obtaining a plurality of nodal points coincident with an intersecting point of the semicircle and semicircular arc and the radial line; and (F4) rotating the semicircle by setting a diameter line thereof to be a rotation axis, thereby expanding the nodal point obtained at the step (F3).

It is preferable that a finite element golf ball model should be obtained through mesh formation such that a ratio of hexahedron elements to all the elements is 95% or more (Step (H)). By a finite element method using the finite element golf ball model, the physical property of the golf ball is analyzed (Step (I)). Consequently, precision in analysis can be enhanced.

A specification suitable for a golf ball can be determined based on the analysis and the golf ball can be manufactured based on the specification.

DESCRIPTION OF THE PREFERRED EMBODIMENTS

The present invention will be described below in detail based on a preferred embodiment with reference to the drawings.

Figure 1:
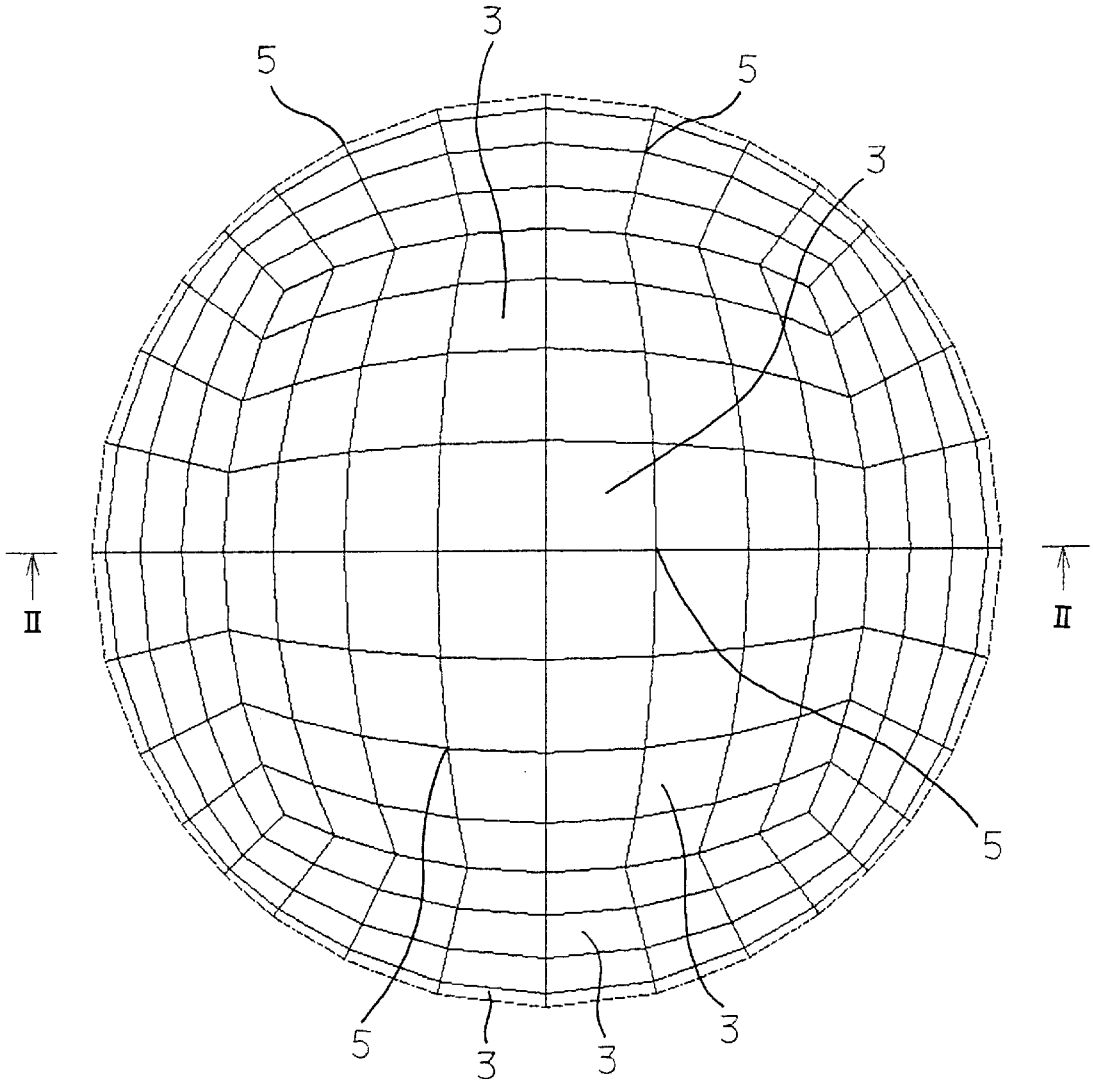
FIG. 1 is a front view showing a finite element golf ball model to be used for an analyzing method according to an embodiment of the present invention.
Figure 2:
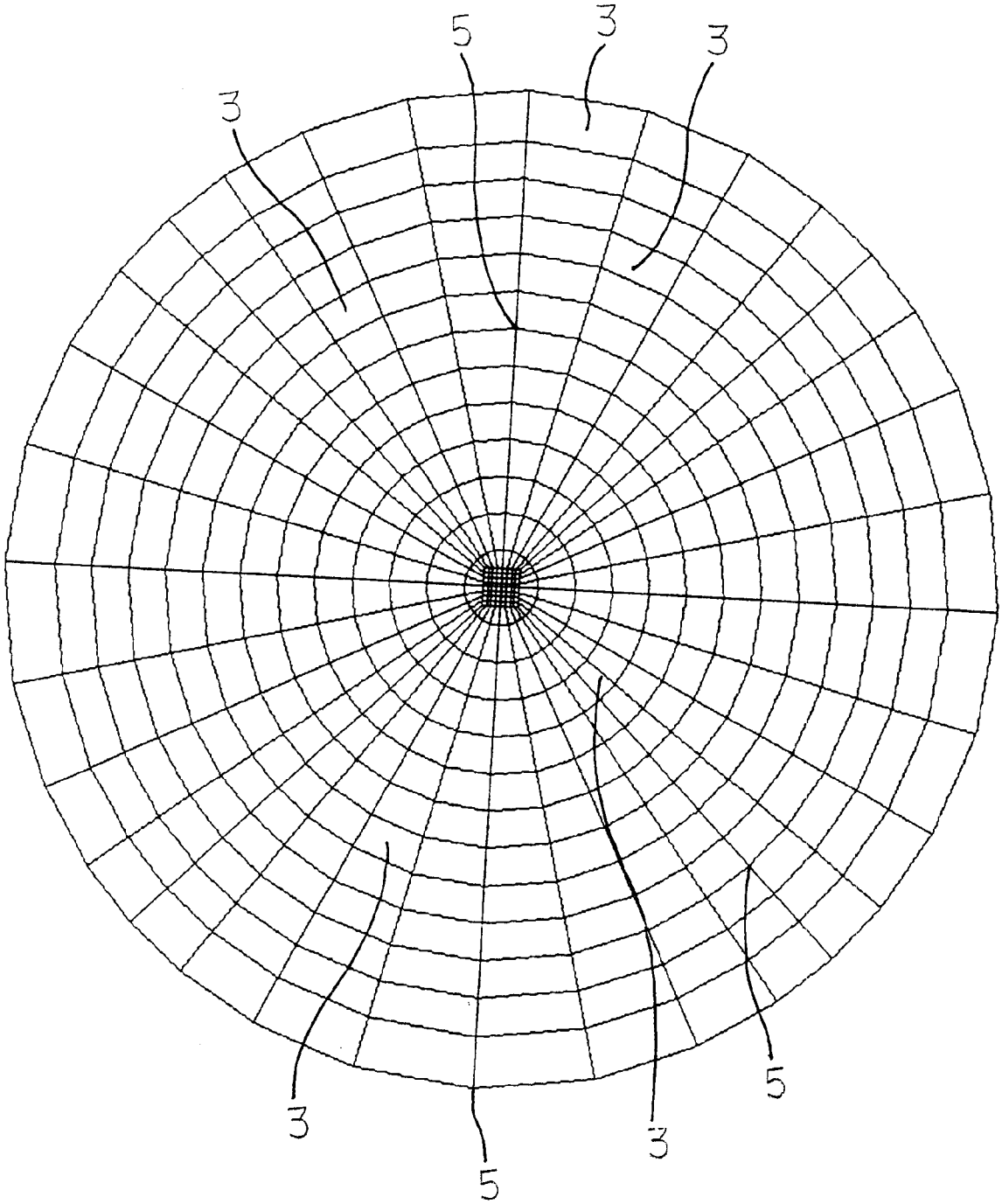
FIG. 2 is a sectional view taken along a line II—II in FIG. 1.

FIG. 1 is a front view showing a finite element golf ball model 1 to be used for an analyzing method according to an embodiment of the present invention. Moreover, FIG. 2 is a sectional view taken along a line II—II in FIG. 1. The finite element golf ball model 1 is divided into a large number of meshed elements 3. A nodal point 5 acts as an apex of each element 3. The procedure for forming the finite element golf ball model 1 will be described below in detail.

Figure 3:
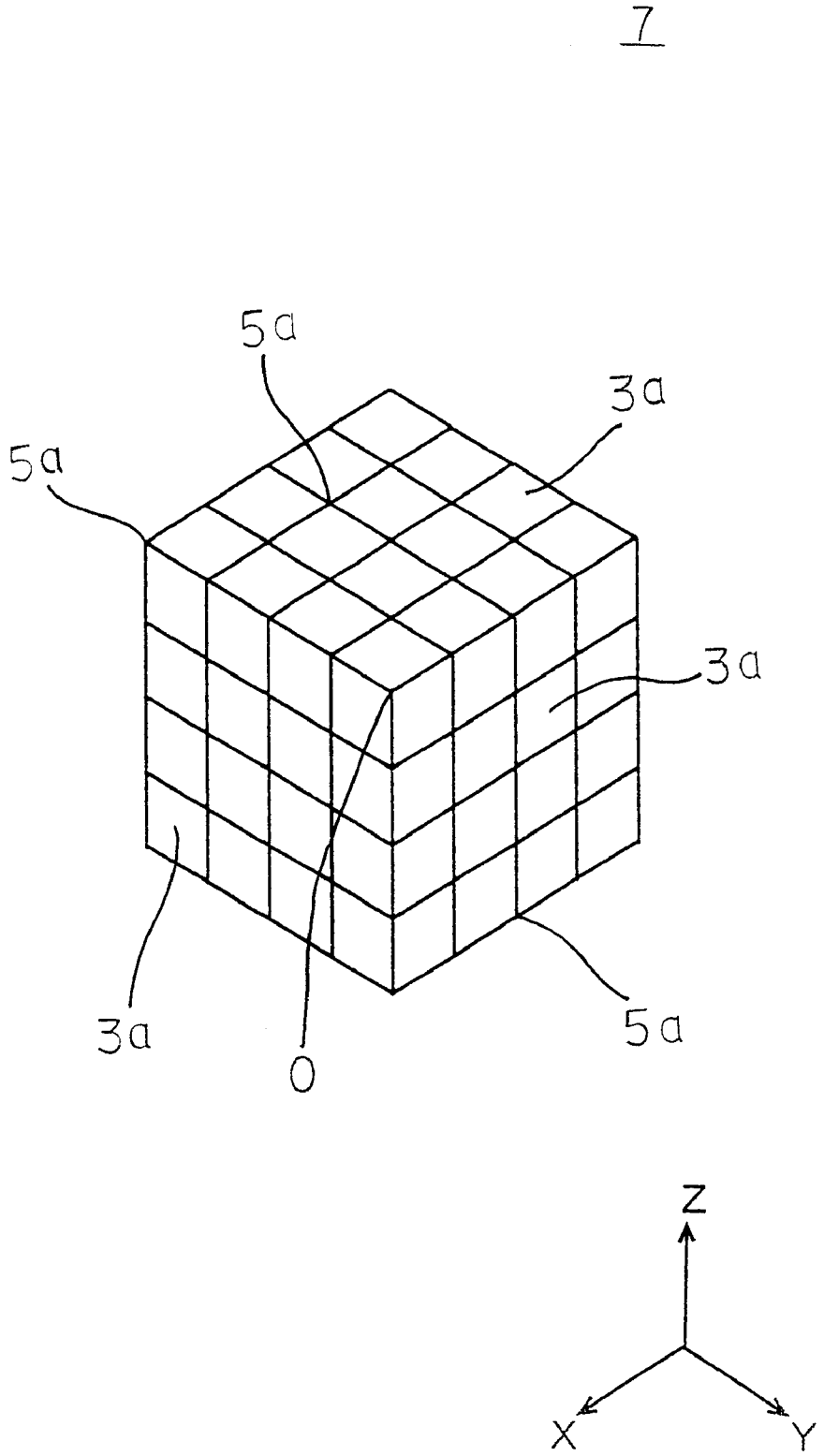
FIG. 3 is a perspective view showing a small cube.

FIG. 3 is a perspective view showing a small cube 7. The small cube 7 is divided into 64 elements 3*a* by a mesh for dividing each side into four equal portions. Each element 3*a* has a shape of a cube (that is, a hexahedron). A nodal point 5*a* acts as the apex of the element 3*a*. The small cube 7 is a portion to be a base point for forming a ⅛ model. The ⅛ model is obtained by dividing the finite element golf ball model 1 into eight equal portions through three planes (an X-Y plane, a Y-Z plane and a Z-X plane) which are orthogonal to each other on an origin O as will be described below in detail. One of apexes of the small cube 7 is coincident with the origin O. Three of six surfaces of the small cube 7 are coincident with the X-Y plane, the Y-Z plane and the Z-X plane, respectively.

Figure 4:
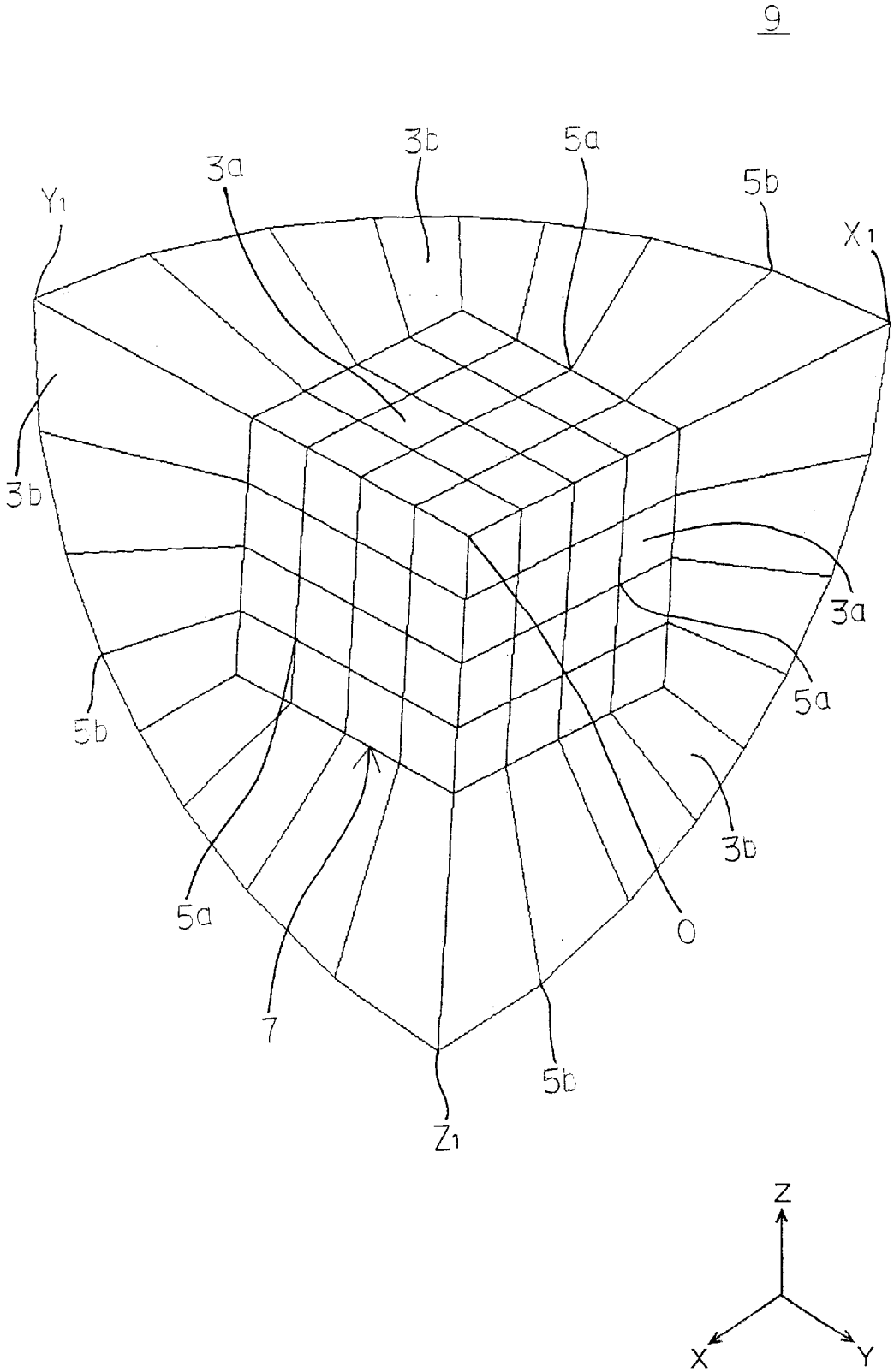
FIG. 4 is a perspective view showing a small ⅛ sphere.

FIG. 4 is a perspective view showing a small ⅛ sphere 9. A center of the small ⅛ sphere 9 is coincident with the origin O and a radius of the sphere is slightly larger than a length of a diagonal line of the small cube 7. More specifically, the small ⅛ sphere 9 includes the small cube 7. An outline of the small ⅛ sphere 9 is formed by three segments ($OX_1$, $OY_1$, $OZ_1$) and three ¼ circular arcs ($X_1$-$Y_1$, $Y_1$-$Z_1$ and $Z_1$-$X_1$). The three ¼ circular arcs ($X_1$-$Y_1$, $Y_1$-$Z_1$ and $Z_1$-$X_1$) are also lines for defining a ⅛ spherical surface. In the small ⅛ sphere 9, a surface $X_1OY_1$ is coincident with the X-Y plane, a surface $Y_1OZ_1$ is coincident with the Y-Z plane and a surface $Z_1OX_1$ is coincident with the Z-X plane.

All the nodal points 5*a* present on surfaces other than three of the six surfaces of the small cube 7 which are shown in FIG. 4 are projected onto the spherical surface of the small ⅛ sphere 9. A projecting method is executed along a line connecting the origin O to the nodal point 5*a* to be a projecting object. A new nodal point 5*b* is formed on an intersecting point of the line and the spherical surface of the small ⅛ sphere 9. A new element 3*b* setting four new nodal points 5*b* and the four nodal points 5*a* on the small cube 7 to be apexes is formed. The new element 3*b* has the shape of a hexahedron.

Figure 5:
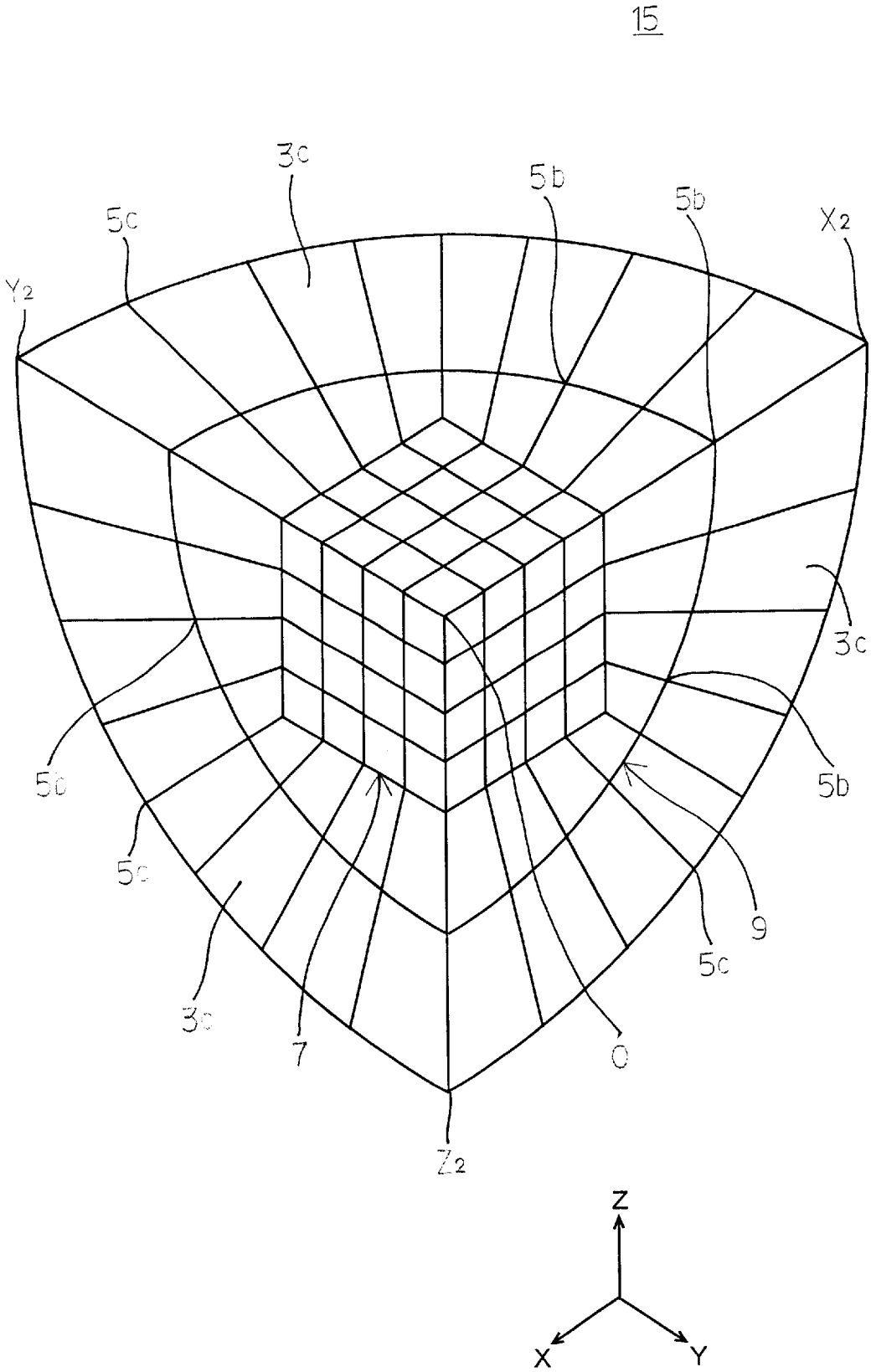
FIG. 5 is a perspective view showing a first intermediate ⅛ sphere.

FIG. 5 is a perspective view showing a first intermediate ⅛ sphere 15. A center of the first intermediate ⅛ sphere 15 is coincident with the origin O and has a radius which is slightly larger than the radius of the small ⅛ sphere 9. An outline of the first intermediate ⅛ sphere 15 is formed by three segments ($OX_2$, $OY_2$, $OZ_2$) and three ¼ circular arcs ($X_2$-$Y_2$, $Y_2$-$Z_2$ and $Z_2$-$X_2$). The three ¼ circular arcs ($X_2Y_2$, $Y_2$-$Z_2$ and $Z_2$-$X_2$) are also lines for defining a ⅛ spherical surface. In the first intermediate ⅛ sphere 15, a surface $X_2OY_2$ is coincident with the X-Y plane, a surface $Y_2OZ_2$ is coincident with the Y-Z plane and a surface $Z_2OX_2$ is coincident with the Z-X plane.

All the nodal points 5*b* present on the spherical surface of the small ⅛ sphere 9 are projected on to the spherical surface of the first intermediate ⅛ sphere 15. A projecting method is executed along a line connecting the origin O to the nodal point 5*b* to be a projecting object. A new nodal point 5*c* is formed on an intersecting point of the line and the first intermediate ⅛ sphere 15. A new element 3*c* setting four new nodal points 5*c* and the four nodal points 5*b* on the small ⅛ sphere 9 to be apexes is formed. The new element 3*c* has the shape of a hexahedron.

Figure 6:
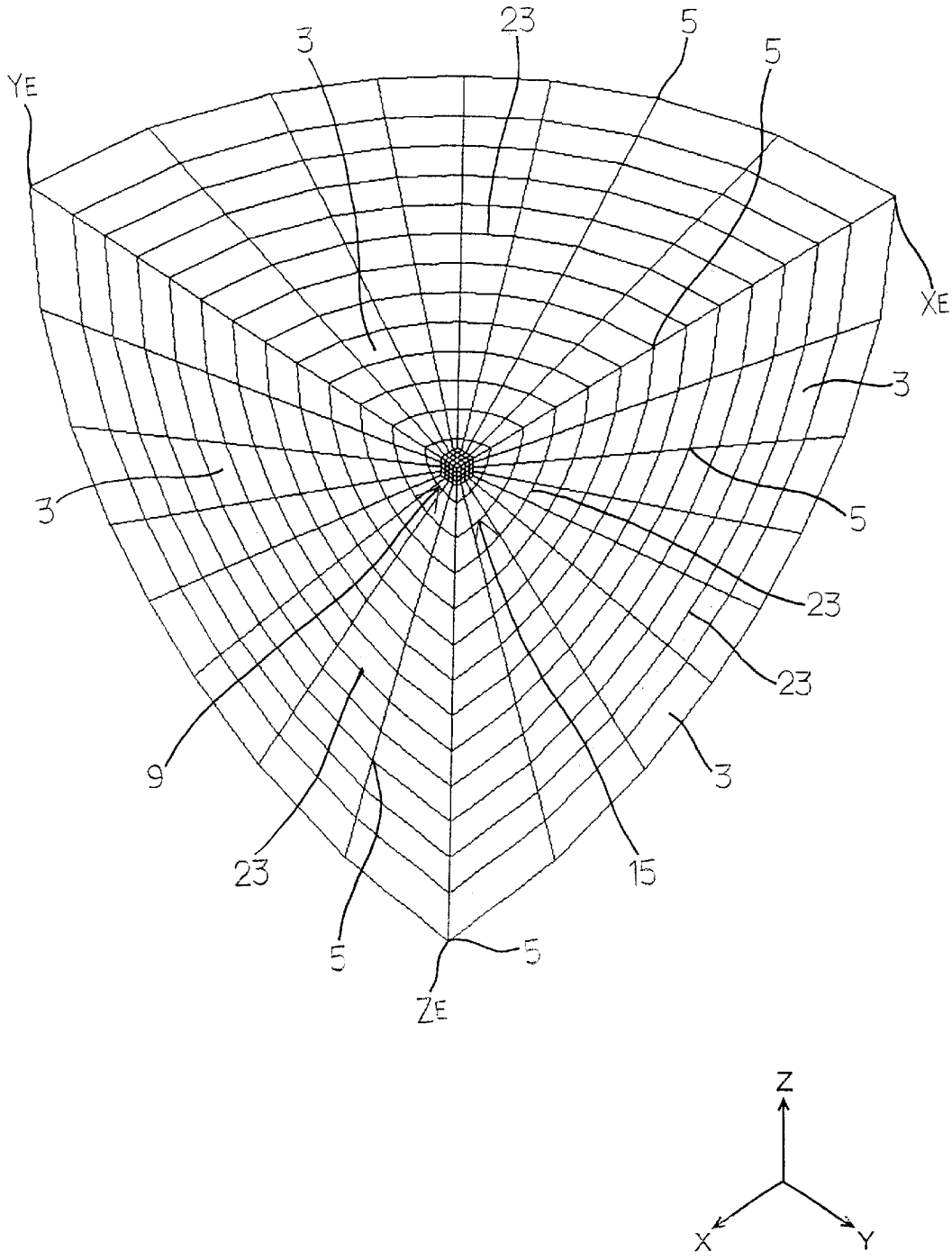
FIG. 6 is a perspective view showing a ⅛ sphere (⅛ model)

FIG. 6 is a perspective view showing a ⅛ sphere 21 (⅛ model). A center of a sphere to be an origination of the ⅛ sphere 21 is coincident with the origin (see FIG. 5) and a radius thereof is coincident with the radius of the golf ball. An outline of the ⅛ sphere 21 is formed by three segments ($OX_E$, $OY_E$, $OZ_E$) and three ¼ circular arcs ($X_E$-$Y_E$, $Y_E$-$Z_E$ and $Z_E$-$X_E$). The three ¼ circular arcs ($X_E$-$Y_E$, $Y_E$-$Z_E$ and $Z_E$-$X_E$) are also lines for defining a ⅛ spherical surface. In the ⅛ sphere, a surface $X_EOY_E$ is coincident with the X-Y plane, a surface $Y_EOZ_E$ is coincident with the Y-Z plane and a surface $Z_EOX_E$ is coincident with the Z-X plane.

A space between the spherical surface of the small ⅛ sphere 9 and that of the ⅛ sphere 21 is divided by a plurality of (twelve in the example of FIG. 6) intermediate ⅛ spheres 23 setting the origin O to be a center. The innermost one of the intermediate ⅛ spheres 23 is the first intermediate ⅛ sphere 15 shown in FIG. 5. In the same method of projecting the nodal point 5*b* on the small ⅛ sphere 9 onto the first intermediate sphere 15, the nodal point 5*c* of the first intermediate ⅛ sphere 15 is projected onto the intermediate ⅛ sphere 23 adjacent to the outside thereof. Thus, a new nodal point is formed. Such an operation for projecting the nodal point present on the inner spherical surface onto the spherical surface adjacent to the outside thereof is sequentially repeated so that a nodal point is formed up to the spherical surface of the ⅛ sphere 21. Consequently, a ⅛ model is obtained. Eight ⅛ models are assumed and are expanded as a sphere. Consequently, the finite element golf ball model 1 shown in FIGS. 1 and 2 is obtained.

The finite element golf ball model 1 comprises 5504 elements 3. Each of these elements 3 is a hexahedron having eight apexes (that is, nodal points). In general, elements such as a tetrahedron, a pentahedron and a hexahedron are assumed by the finite element method and an element 3 to be the hexahedron is the most excellent in the precision in expression of a deformation behavior because eight integration points can be used. Since all the elements 3 of the finite element golf ball model 1 shown in FIGS. 1 and 2 are hexahedrons, they are excellent in the precision in analysis. As a matter of course, it is not required that all the elements 3 are the hexahedrons but the elements 3 having the shape of a tetrahedron and the like other than the hexahedron and the hexahedron element 3 may be present together. From the viewpoint of the precision in analysis, the ratio of the number of the hexahedron elements 3 to that of all the elements 3 is preferably 70% or more, more preferably 75% or more, most preferably 80% or more, and ideally 100%.

It is preferable that the number of the elements 3 included in the finite element golf ball model 1 is 864 to 100000. If the number of the elements 3 is less than 864, the precision in analysis becomes insufficient in some cases. From this viewpoint, the number of the elements 3 is preferably 1664 or more, and more preferably 2816 or more. If the number of the elements 3 is more than 100000, it takes a great deal of time and labor to carry out the analysis. From this viewpoint, the number of the elements 3 is preferably 50000 or less, and more preferably 20000 or less. As a matter of course, as a throughput of a computer is more enhanced, the number of the elements 3 can be set to be larger.

64 elements 3*a* included in the small cube 7 are regular octahedrons and have peculiar shapes in a sense as compared with the shapes of the elements 3 of the whole finite element golf ball model 1. If the size of the element 3*a* of the regular hexahedron is smaller, the precision in analysis is more enhanced. If the same size is too small, a longer time is required for calculation. The size of the element 3*a* of the regular hexahedron is usually determined such that the ratio of the length of one side in the small cube 7 to the diameter of the finite element golf ball model 1 is 0.9% or more. As a matter of course, as the throughput of the computer is more enhanced, the size of the element 3*a* of the regular hexahedron can be more reduced. It is required that the side of the small cube 7 should have such a length that the small cube 7 is included in the small ⅛ sphere 9.

While such a mesh as to divide one side of the small cube 7 into four equal portions has been assumed in this example, the number of divisions for one side is not restricted thereto. For example, the small cube 7 is divided into 27 elements 3*a* if such a mesh as to divide one side into three equal portions is assumed, and the small cube 7 is divided into 125 elements 3*a* if such a mesh as to divide one side into five equal portions is assumed. The number of divisions for one side is preferably 3 to 20, and more preferably 3 to 15. If the number of divisions is less than the above-mentioned range, the precision in analysis becomes insufficient in some cases. If the number of divisions is more than the above-mentioned range, it takes a great deal of time and labor to carry out calculation for forming the finite element golf ball model 1 or calculation for the analysis. As a matter of course, if the throughput of the computer is more enhanced, the number of divisions can be set to be larger.

Figure 7:
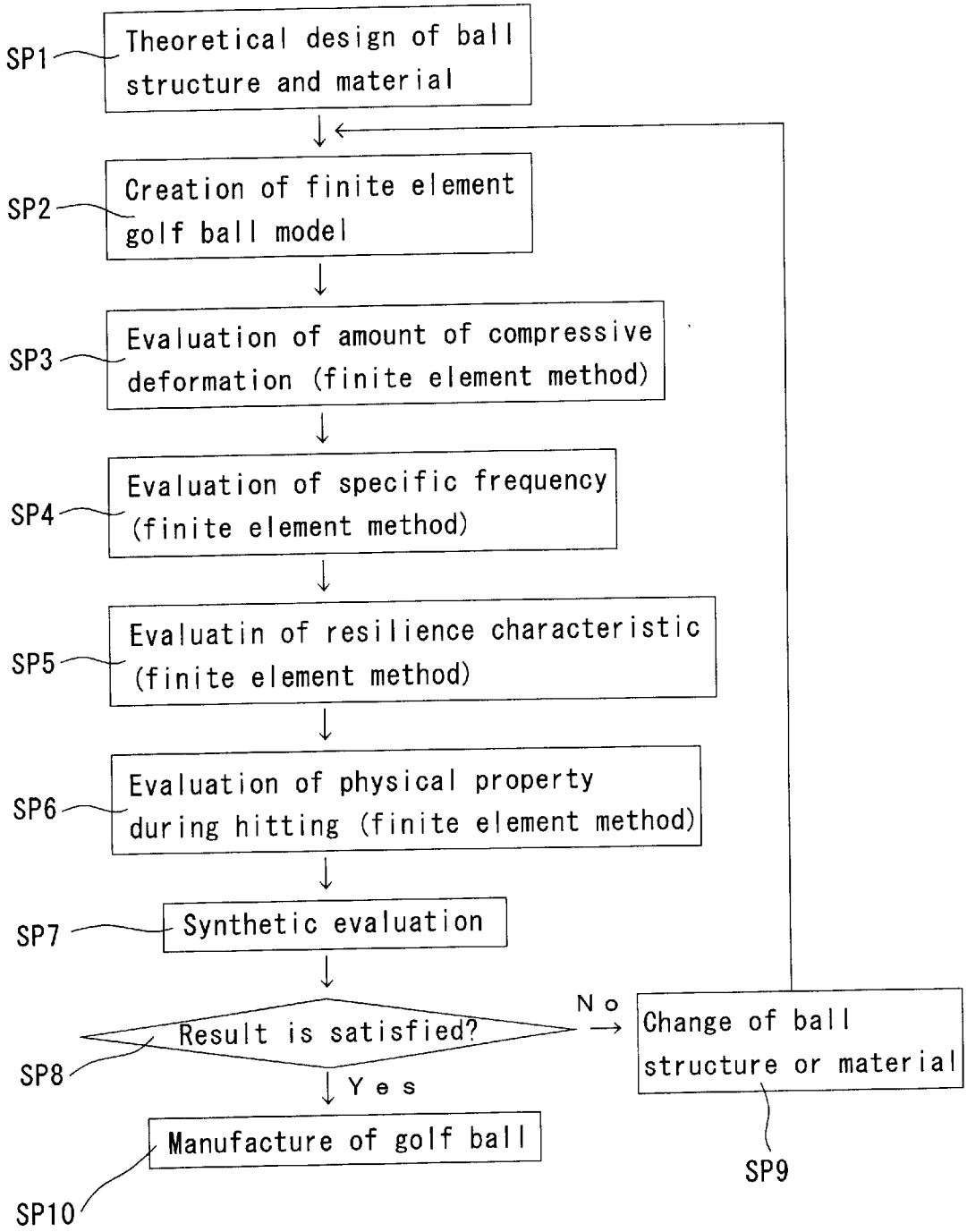
FIG. 7 is a flow chart showing an example of a method of analyzing a physical property of a golf ball using the finite element golf ball model illustrated in FIGS. 1 and 2.

FIG. 7 is a flow chart showing an example of the method of analyzing a physical property of a golf ball using the finite element golf ball model 1 illustrated in FIGS. 1 and 2. In the analyzing method, first of all, a structure of a golf ball and a material to be used are designed theoretically (SP1). Next, the finite element golf ball model 1 is created based on the design data (SP2). Then, an amount of compressive deformation (SP3), a specific frequency (SP4), a resilience characteristic (SP5) and a physical property during hitting (SP6) are evaluated. The physical property during hitting implies an initial velocity, a spin rate, a launch direction and the like in the golf ball which are obtained by hitting with a golf club. The evaluation from SP3 to SP6 is carried out through a known finite element method. These results are synthetically evaluated (SP7) and it is decided whether the results are satisfied or not (SP8) If the results cannot be satisfied, the results of the evaluation are fed back to the design and the structure and material of the golf ball are designed again (SP9). If the results can be satisfied, a golf ball is manufactured based on the design (SP10).

Figure 8:
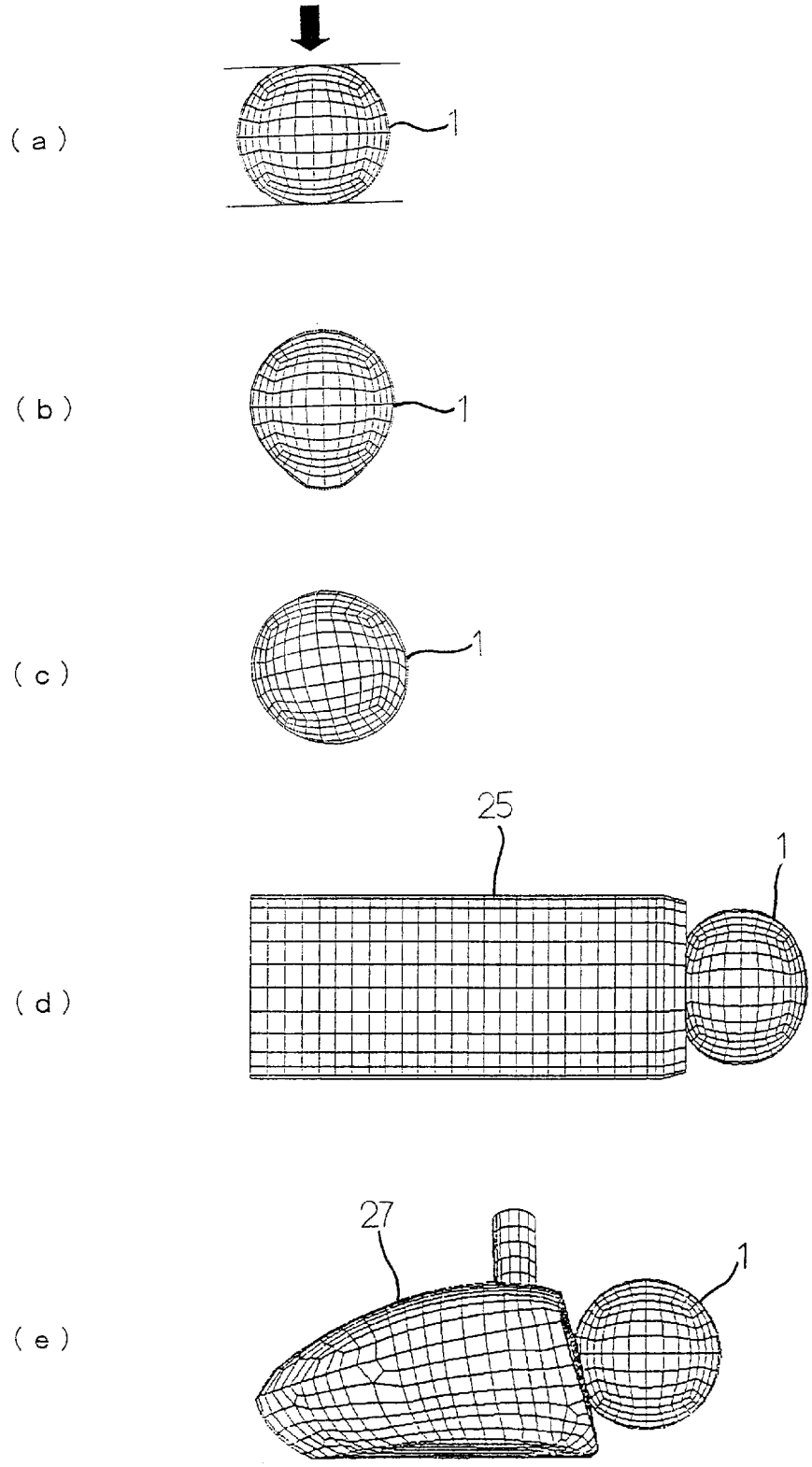
FIG. 8 is a front view illustrating a behavior of each element during analysis.

FIG. 8(*a*) shows an example of the behavior of each element 3 which is obtained during the analysis of the amount of compressive deformation in the finite element golf ball model 1, FIG. 8(*b*) shows an example of the behavior of the element 3 which is obtained during the analysis of the specific frequency in a compression mode, FIG. 8(*c*) shows an example of the behavior of the element 3 which is obtained during the analysis of the specific frequency in a torsion mode, FIG. 8(*d*) shows an example of the behavior of the element 3 during the analysis of the resilience characteristic in impact with a hollow metal pole 25, and FIG. 8(*e*) shows an example of the behavior of the element 3 during the analysis of the physical property during hitting with a golf club 27. In the analyzing method, not only the physical property of the whole golf ball but also a deformed shape, a stress distribution, a distortion distribution, an energy distribution and the like in each portion can be obtained as a time history.

The analyzing method shown in FIGS. 7 and 8 are only illustrative and the analysis does not need to be always carried out in this procedure. For example, the order of the evaluation from SP3 to SP6 may be changed and a part of evaluation items may be omitted. Furthermore, items other than the items shown in FIGS. 7 and 8 may be evaluated by the finite element method.

While the finite element golf ball model 1 is obtained from the ⅛ model 21 in the method of forming the finite element golf ball model 1 shown in FIGS. 1 to 6, the finite element golf ball model may be formed without assuming the ⅛ model 21. For example, the small cube may be assumed on the center of a sphere. In this case, the small cube is first divided into meshes so that a nodal point is obtained. Next, the nodal point on the surface of the small cube is projected onto the spherical surface of a small sphere which includes the small cube and has a center thereof coincident with the center of the golf ball. Thus, a new nodal point is obtained. Then, a space between the spherical surface of the small sphere and that of the golf ball is divided by the spherical surfaces of a plurality of intermediate spheres having centers thereof which are coincident with the center of the golf ball. Thus, the operation for projecting the nodal point present on the inner spherical surface onto a spherical surface adjacent to the outside thereof is sequentially repeated from the small sphere to the spherical surface of the golf ball through the intermediate spheres. Thus, the finite element golf ball model is formed. In this case, the ratio of the number of the hexahedron elements to that of all the elements is preferably 70% or more, more preferably 75% or more, most preferably 80% or more, and ideally 100%. In this case, moreover, it is preferable that the ratio of the length of one side in the small cube to the diameter of the finite element golf ball model should be 0.9% or more.

Figure 9:
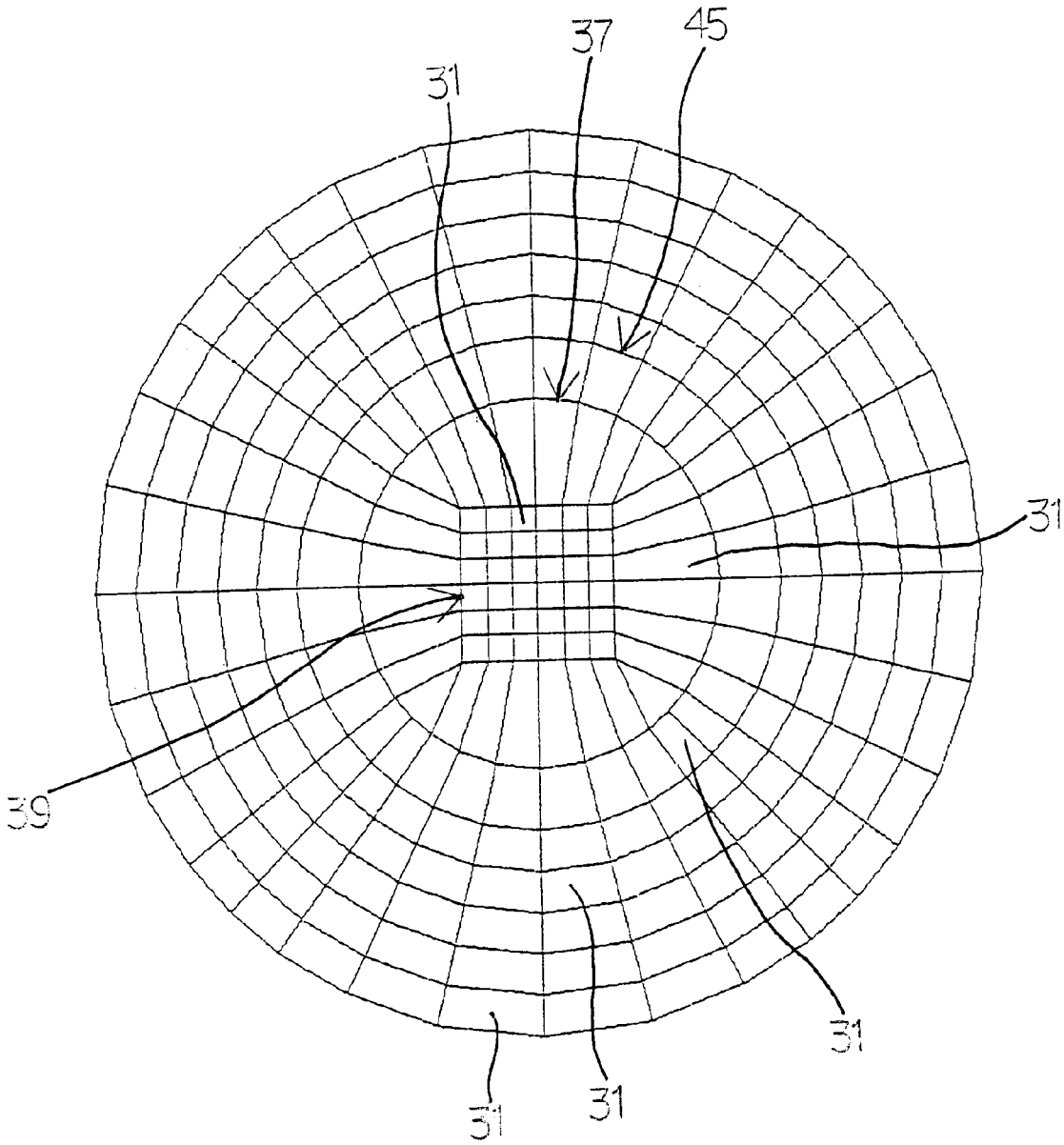
FIG. 9 is a sectional view showing a finite element golf ball model to be used for an analyzing method according to another embodiment of the present invention.

FIG. 9 is a sectional view showing the finite element golf ball model 29 to be used for an analyzing method according to an other embodiment of the present invention. The finite element golf ball model 29 is also divided into a large number of meshed elements 31.

Figure 10:
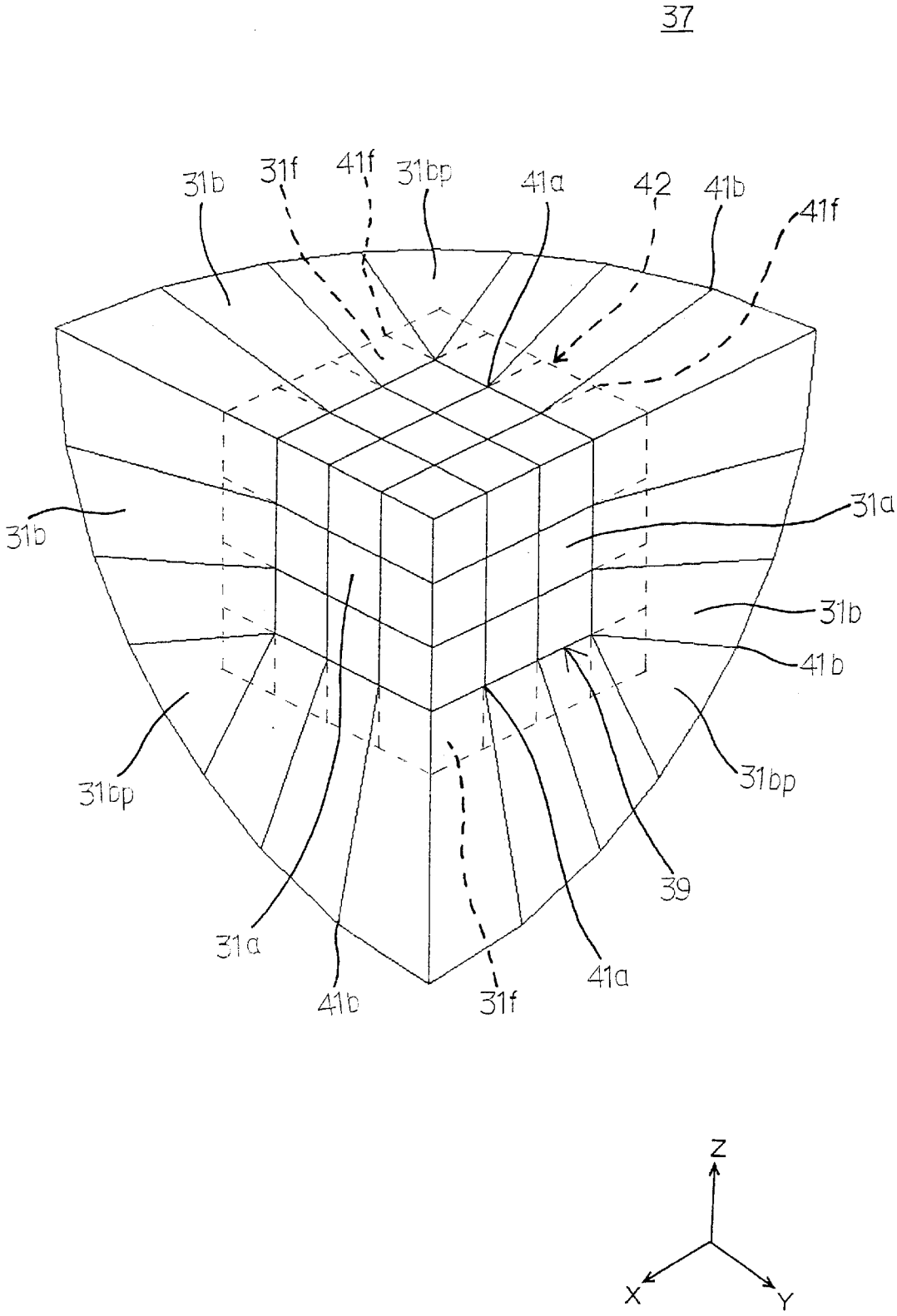
FIG. 10 is a perspective view showing a small ⅛ sphere of the finite element golf ball model illustrated in FIG. 9.

FIG. 10 is a perspective view showing a small ⅛ sphere 37 of the finite element golf ball model 29 in FIG. 9. The small ⅛ sphere 37 includes a small cube 39. The small cube 39 is formed into 27 elements 31*a* through a mesh for dividing each side into three equal portions. A nodal point 41*a* acts as an apex of the element 31*a*. Each side of the small cube 39 is extended to be ⅔ times as long as the same side so that a virtual cube 42 shown in a dotted line of FIG. 10 is assumed. The virtual cube 42 includes 27 elements 31*a* and 37 virtual elements 31*f*. A virtual nodal point 41*f* acts as an apex of the virtual element 31*f*. All the virtual nodal points 41*f* present on surfaces other than three of the six surfaces of the virtual cube 42 which are shown in FIG. 10 are projected onto the spherical surface of the small ⅛ sphere 37 through a line connecting the virtual nodal point 41*f* and the origin. By the projection, a new nodal point 41*b* is formed on the spherical surface of the small ⅛ sphere 37. A new element 31*b* setting four new nodal points 41*b* and four nodal points 41*a* on the small cube 39 to be apexes is formed. The new element 31*b* has the shape of a hexahedron. An element 31*bp* (hereinafter referred to as an "apex portion element") which includes the apexes of the small cube 39 is shown in a triangle in FIG. 10. The virtual nodal point 41*f* is also projected onto the center of a circular arc corresponding to one side of the triangle so that the new nodal point 41*b* is assumed. Therefore, the apex portion element 31*bp* is also a hexahedron having eight nodal points.

The virtual cube 42 is used for only obtaining the nodal point 41*b*. Accordingly, the virtual cube 42, the virtual element 31*f* and the virtual nodal point 41*f* are not used for subsequent calculation in the finite element method.

The nodal point of the small ⅛ sphere 37 is projected onto a first intermediate ⅛ sphere 45 (see FIG. 9). In the same manner as the finite element golf ball model 29 shown in FIGS. 1 to 6, the operation for projecting nodal points present on an inner spherical surface onto a spherical surface adjacent to the outside thereof is sequentially repeated. Consequently, a ⅛ model is obtained. Eight ⅛ models are expanded as a sphere so that the finite element golf ball model 29 shown in FIG. 9 is finished.

The finite element golf ball model 29 wholly includes 2816 elements 31. All these elements 31 are hexahedrons. For this reason, an analyzing method using the finite element golf ball model 29 is excellent in precision in analysis. From the viewpoint of the precision in analysis, the ratio of the number of the hexahedron elements to the number of all the elements 31 is preferably 70% or more, more preferably 75% or more, most preferably 80% or more, and ideally 100%.

It is preferable that the number of the elements 31 included in the finite element golf ball model 29 is 864 to 100000. If the number of the elements 31 is less than 864, the precision in analysis becomes insufficient in some cases. From this viewpoint, the number of the elements 31 is preferably 1664 or more, and more preferably 2816 or more. If the number of the elements 31 is more than 100000, it takes a great deal of time and labor to carry out the analysis. From this viewpoint, the number of the elements 31 is preferably 50000 or less, and more preferably 20000 or less.

Also in the finite element golf ball model 29, it is preferable that the ratio of the length of one side in the small cube 39 to the diameter of the finite element golf ball model 29 should be 0.9% or more. Moreover, the number of divisions of one side in the small cube 39 is preferably 3 to 20, and more preferably 3 to 15. Also in the case in which the finite element golf ball model 29 is used, the physical property of the golf ball can be analyzed in the same procedure as the procedure shown in FIGS. 7 and 8.

While the finite element golf ball model 29 is obtained from the ⅛ model in the method of forming the finite element golf ball model 29 shown in FIGS. 9 and 10, the finite element golf ball model may be formed without assuming the ⅛ model. For example, the small cube may be assumed on the center of the sphere and the nodal point of the small cube may be sequentially projected onto the spherical surface to obtain the finite element golf ball model. Also in this case, the ratio of the number of the hexahedron elements to the number of all the elements is preferably 70% or more, more preferably 75% or more, most preferably 80% or more, and ideally 100%. In this case, moreover, it is preferable that the ratio of the length of one side in the small cube to the diameter of the finite element golf ball model should be 0.9% or more.

Figure 11:
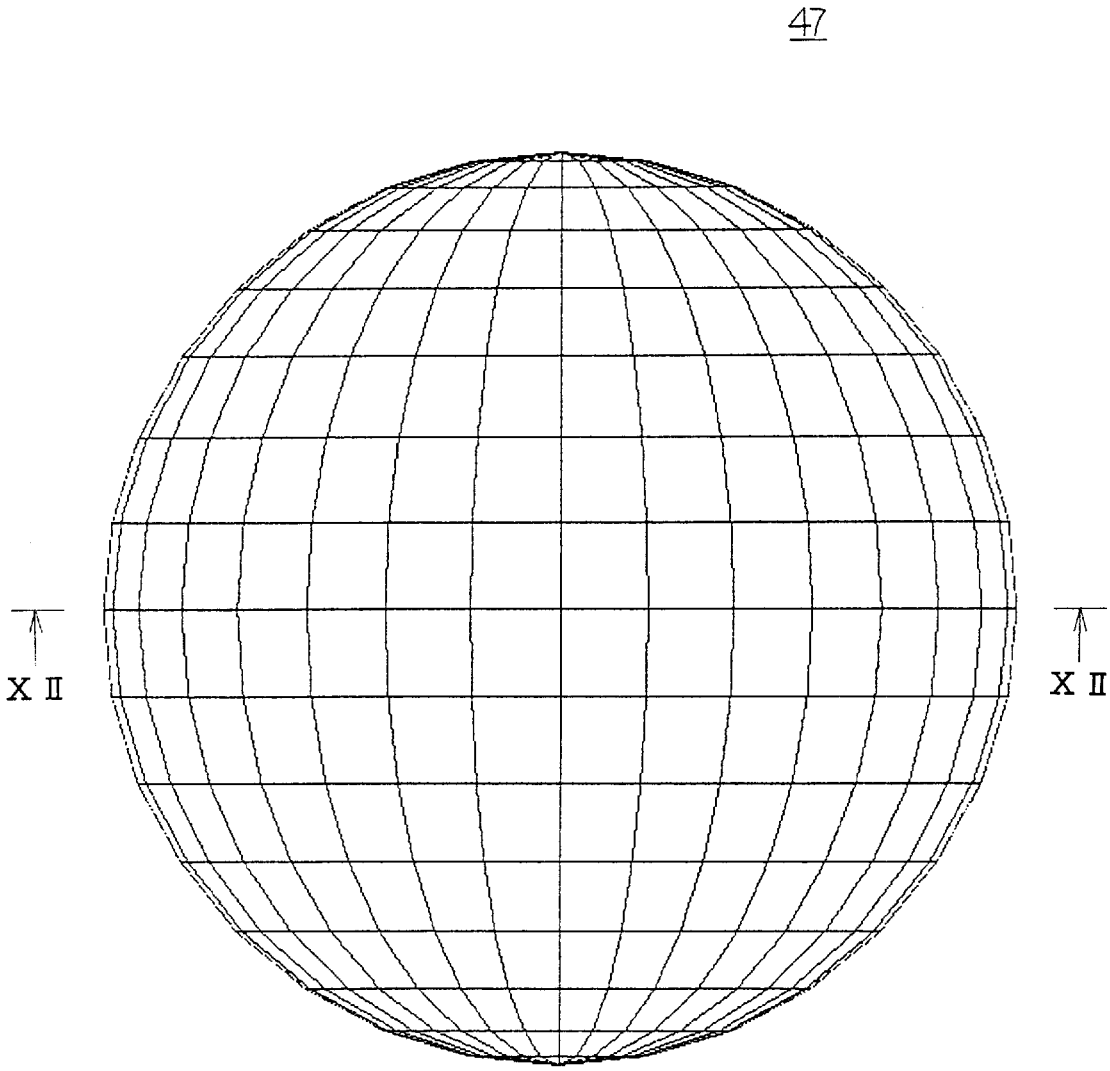
FIG. 11 is a front view showing a finite element golf ball model to be used for an analyzing method according to a further embodiment of the present invention.
Figure 12:
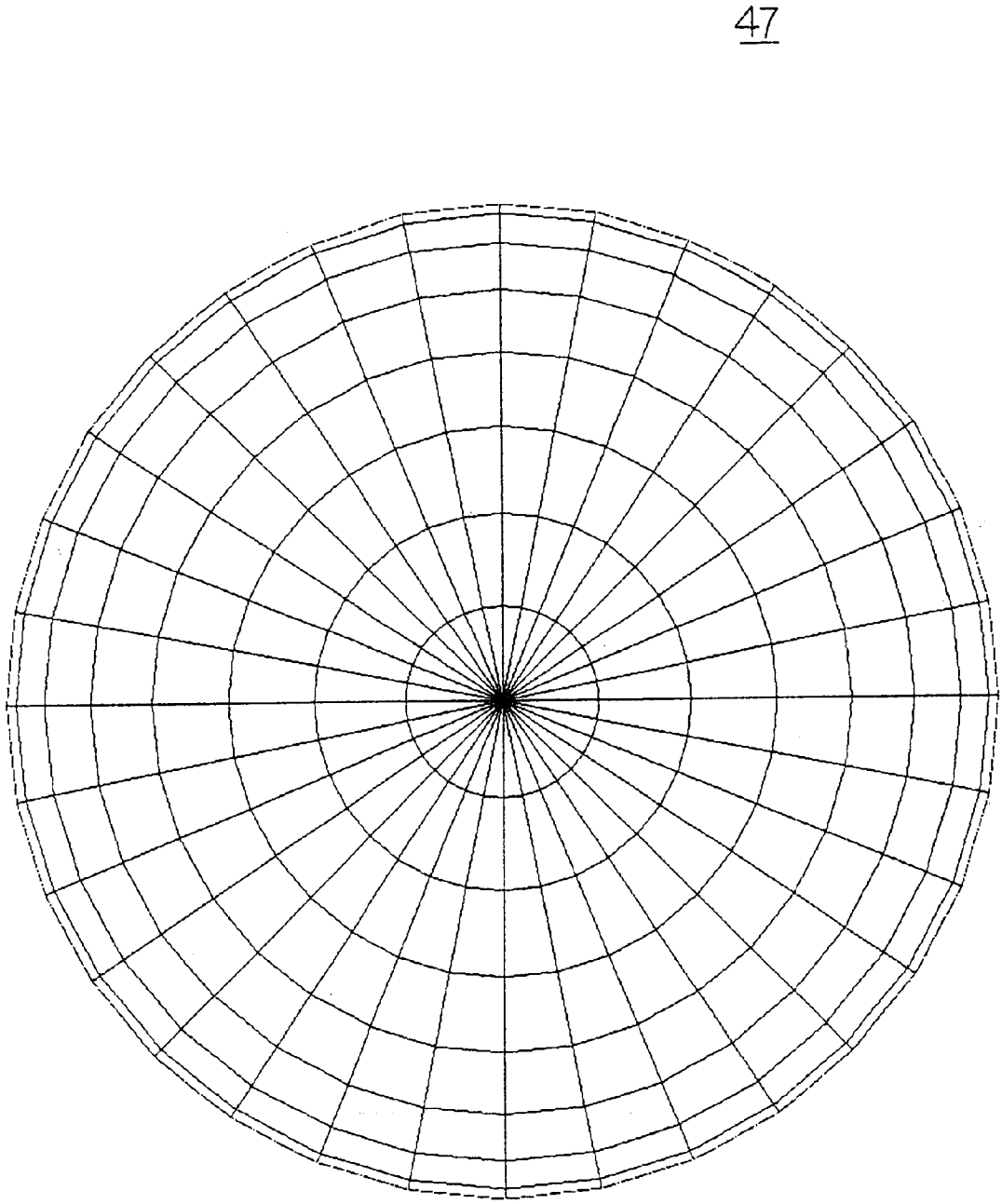
FIG. 12 is a sectional view taken along a line XII—XII in FIG. 11.
Figure 13:
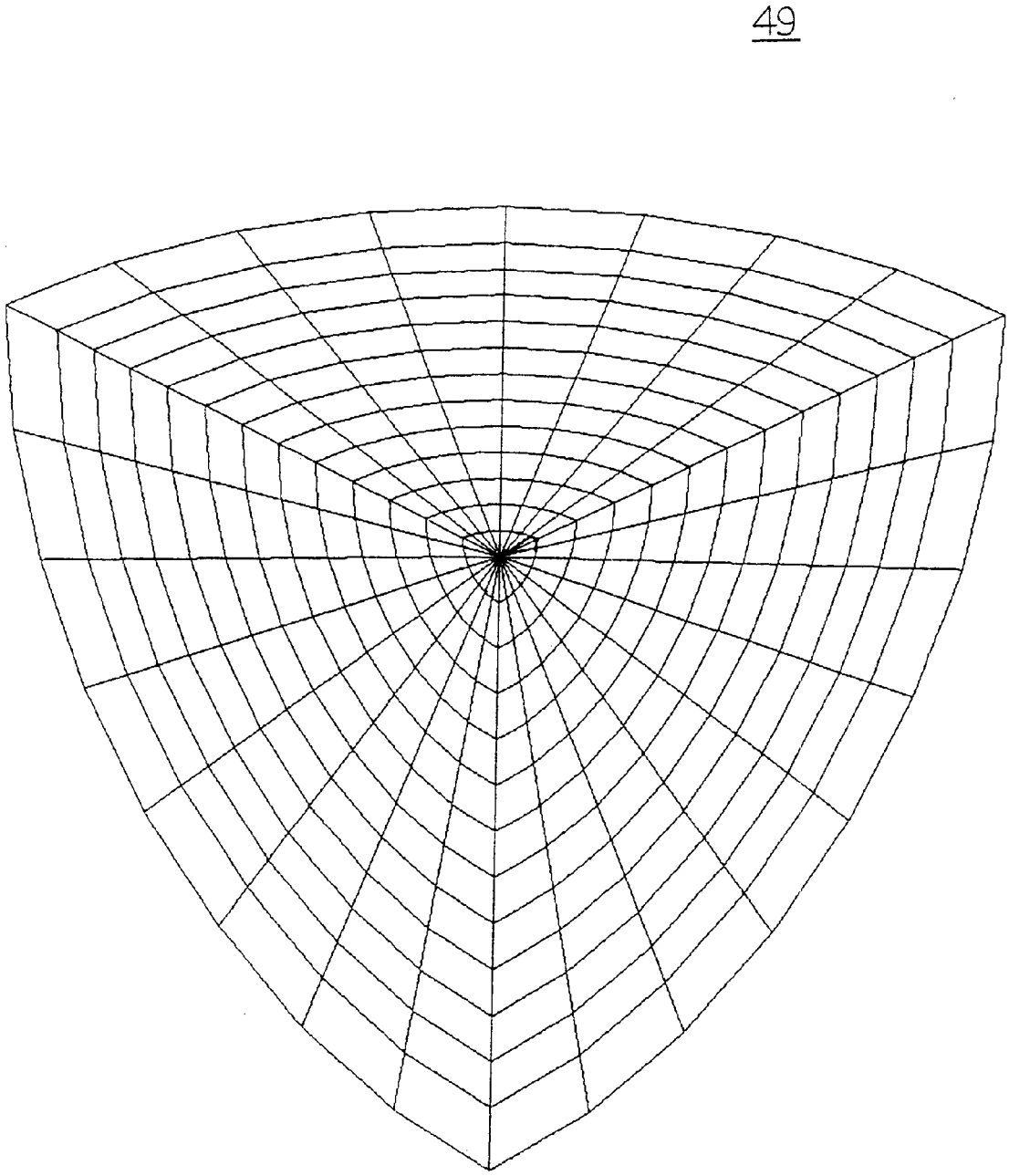
FIG. 13 is a perspective view showing a ⅛ model of the finite element golf ball model in FIG. 11.

FIG. 11 is a front view showing a finite element golf ball model 47 to be used for an analyzing method according to a further embodiment of the present invention. Moreover, FIG. 12 is a sectional view taken along a line XII—XII in FIG. 11. Furthermore, FIG. 13 is a perspective view showing a ⅛ model 49 of the finite element golf ball model 47 in FIG. 11.

Figure 14:
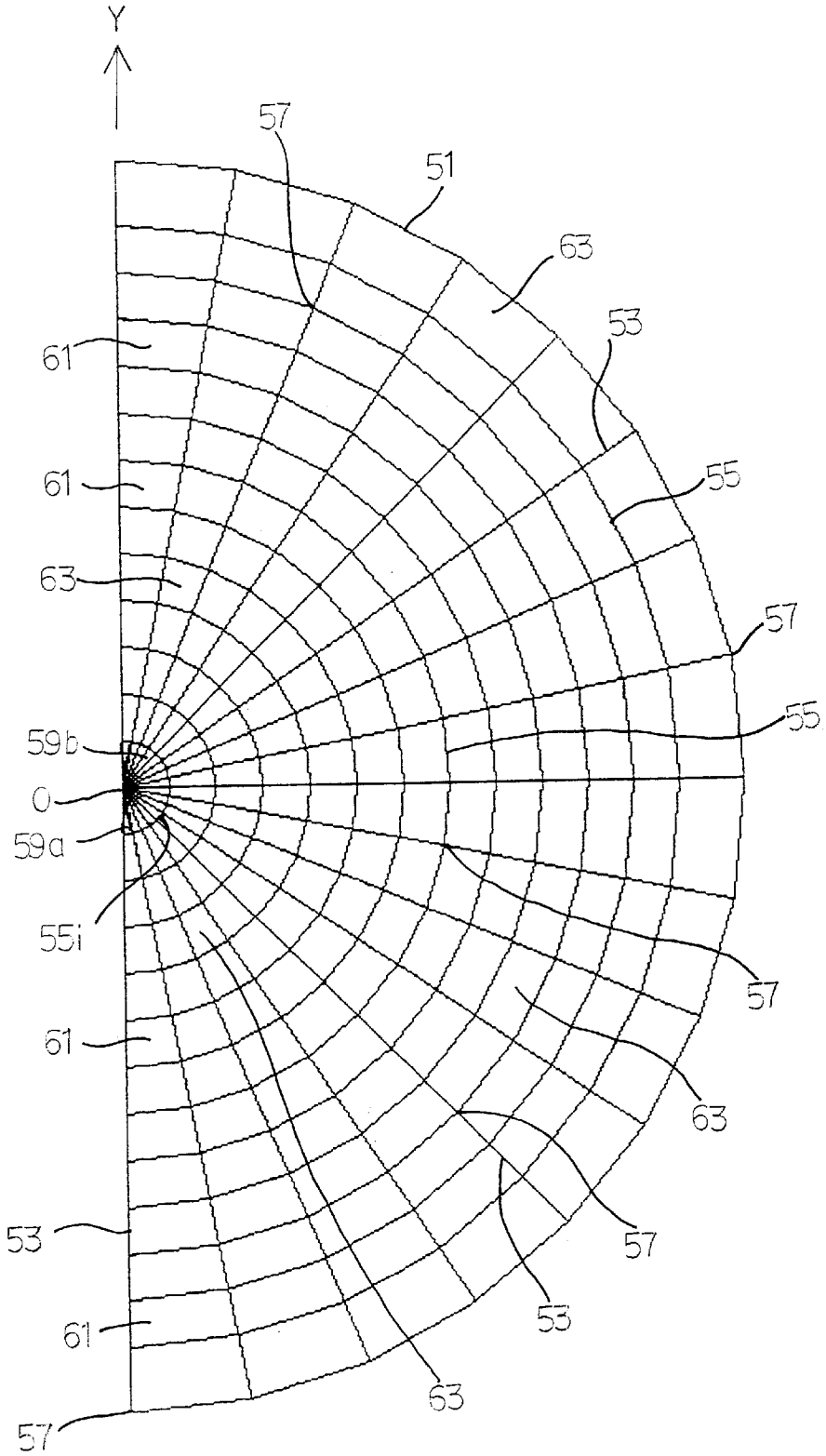
FIG. 14 is a front view showing a semicircular graphic for forming the finite element golf ball model in FIG. 11.

In order to form the finite element golf ball model 47, first of all, a semicircle 51 having the same diameter as that of the finite element golf ball model 47 is assumed as shown in FIG. 14. Next, a large number of (17 in FIG. 14) radial lines 53 are assumed from a center O of the semicircle 51 toward an arc. Then, a large number of (12 in FIG. 14) semicircular arcs 55 which are concentric with the semicircle 51 and have smaller diameters than the diameter of the semicircle 51 are assumed. An intersecting point of the radial line 53 and the semicircle 51 and that of the radial line 53 and the semicircular arc 55 are set to be nodal points 57.

A graphic shown in FIG. 14 is rotated by setting a diameter line (a Y-axis in FIG. 14) to be a rotation axis. The rotation is intermittently carried out at intervals of a predetermined angle (11.25 degrees in this example). When the graphic shown in FIG. 14 becomes stationary during the rotation, a new nodal point is assumed in the position of the nodal point 57. Thus, the sphere is divided into a large number of elements through the nodal point obtained while the graphic carries out one rotation (that is, a rotation of 360 degrees). Consequently, the finite element golf ball model 47 shown in FIGS. 11 to 13 is finished.

In FIG. 14, an element 59 in an innermost semicircular arc 55*i* is shown in a triangle. The three-dimensional shape of an element 59*a* in the element 59 which is provided in contact with a rotation axis Y is a triangular pyramid (tetrahedron). Moreover, the three-dimensional shape of an element 59*b* of the element 59 in the innermost semicircular arc 55*i* which is not provided in contact with the rotation axis Y is a pyramid (pentahedron). Furthermore, the three-dimensional shape of an element 61 which is positioned on the outside of the innermost semicircular arc 55*i* in contact with the rotation axis Y is a triangular prism (pentahedron). The three-dimensional shapes of other elements 63 are hexahedrons. The finite element golf ball model 47 includes 64 tetrahedron elements 59*a,* 1216 pentahedron elements 59*b* and 61 and 5376 hexahedron elements 63. The ratio of the number of the hexahedron elements 63 to the number of all the elements is 81%. From the viewpoint of the precision in analysis, the ratio of the number of the hexahedron elements 63 to the number of all the elements is preferably 70% or more, more preferably 75% or more, and most preferably 80% or more.

In the finite element golf ball model 47, the ratio of the total volume of the hexahedron element 63 to the total volume of all the elements is 81%. From the viewpoint of the precision in analysis, the ratio of the total volume of the hexahedron element 63 to the total volume of all the elements is preferably 70% or more, more preferably 75% or more, and most preferably 80% or more.

It is preferable that the number of the elements 59, 61 and 63 included in the finite element golf ball model 47 is 2000 to 100000. If the number of the elements 59, 61 and 63 is less than 2000, the precision in analysis becomes insufficient in some cases. From this viewpoint, the number of the elements 59, 61 and 63 is preferably 2880 or more, and more preferably 6656 or more. If the number of the elements 59, 61 and 63 is more than 100000, it takes a great deal of time and labor to carry out the analysis. From this viewpoint, the number of the elements 59, 61 and 63 is preferably 50000 or less, and more preferably 20000 or less.

In the finite element golf ball model 47, it is preferable that the radius of the innermost semicircular arc 55*i* should be less than 2 mm. Consequently, all the elements which are present in a region provided apart from a center by 2 mm or more and are not in contact with the rotation axis Y are the hexahedron elements. Thus, the precision in analysis can be enhanced. It is preferable that 90% or more, particularly 95% or more of the elements present in the region provided apart from the center by 2 mm or more should be the hexahedron elements.

From the viewpoint of an enhancement in the precision in analysis and a reduction in the time and labor for the analysis, the number of the radial lines 53 to be assumed is preferably 13 to 61, and more preferably 17 to 37. From the same viewpoint, moreover, an angle interval is preferably 3 degrees to 15 degrees, and more preferably 5 degrees to 11.25 degrees when the graphic shown in FIG. 14 is to be rotated.

Also in the case in which the finite element golf ball model 47 is to be used, the physical property of the golf ball can be analyzed in the same procedure as the procedure shown in FIGS. 7 and 8.

Figure 15:
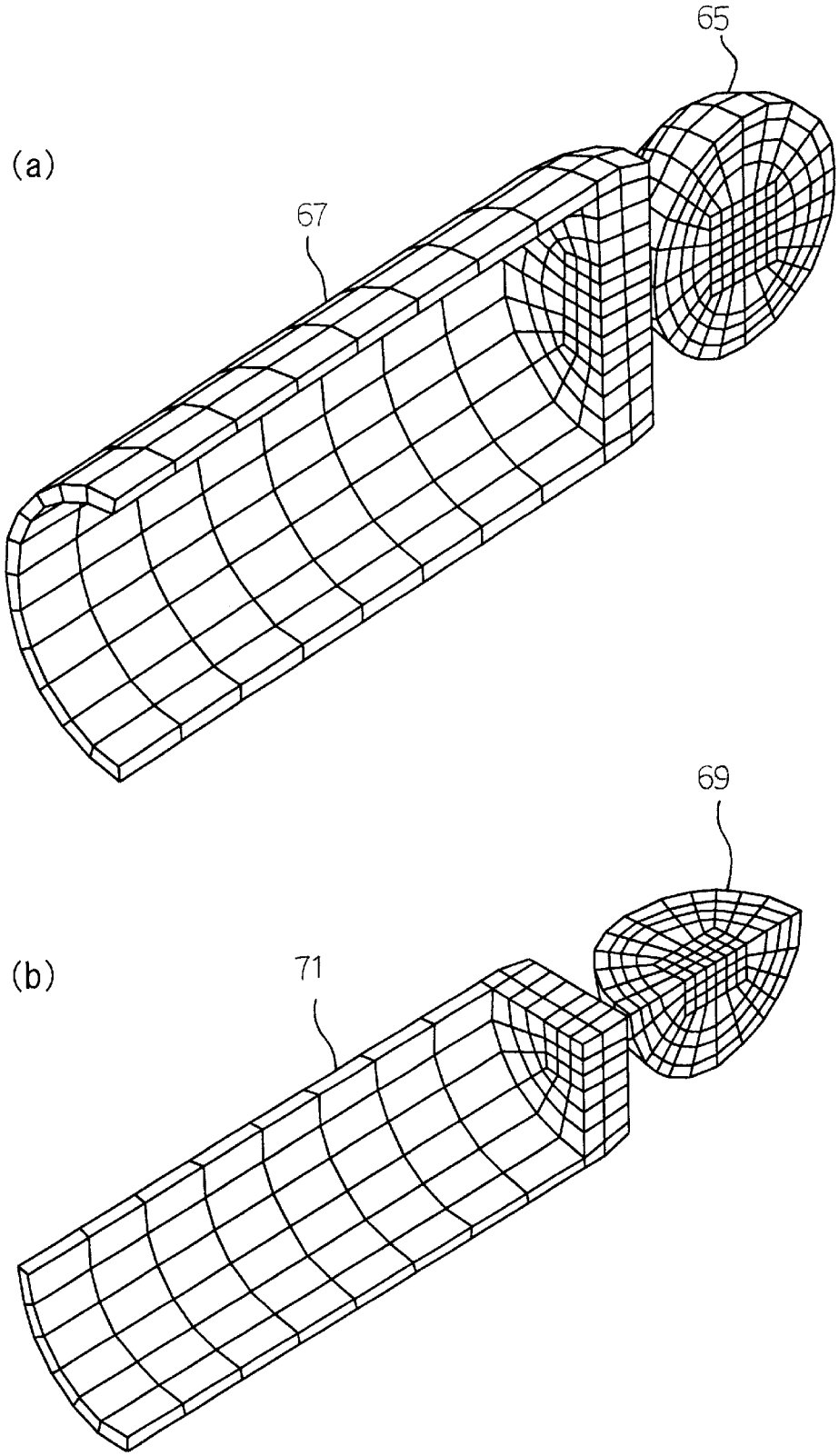
FIG. 15 is a perspective view showing a state in which a resilience characteristic is analyzed when the finite element golf ball model impacts a hollow metal pole.

While all of the finite element golf ball model 1 shown in FIG. 1, the finite element golf ball model 29 shown in FIG. 9 and the finite element golf ball model 47 shown in FIG. 11 are almost spherical, a finite element golf ball model having an almost semispherical shape (½ spherical shape) or an almost ¼ spherical shape may be assumed. FIG. 15(*a*) is a perspective view showing a state in which a resilience characteristic is analyzed when a semispherical finite element golf ball model 65 impacts with a ½ hollow metal pole 67, and FIG. 15(*b*) is a perspective view showing a state in which a resilience characteristic is analyzed when a ¼ spherical finite element golf ball model 69 impacts with a ¼ hollow metal pole 71. Since the golf ball is spherical and is excellent in symmetry, the semispherical finite element golf ball model 65 and the ¼ spherical finite element golf ball model 69 can also be analyzed without a deterioration in measuring precision by utilizing a translation restraint and a rotation restraint. In addition, a time required for the model assumption and analysis processing can be shortened by using the semispherical finite element golf ball model 65 and the ¼ spherical finite element golf ball model 69.

As described above, the present invention provides a useful and simple mesh forming method for a golf ball. By using a finite element golf ball model obtained by the mesh formation, the physical property of the golf ball can be analyzed easily with high precision through a finite element method. Consequently, it is possible to shorten a time required from the design of the golf ball to the manufacture thereof.

The above description is only illustrative and various changes can be made without departing from the scope of the invention.

What is claimed is:

1. A method of analyzing a physical property of a golf ball comprising the steps of:

(H) obtaining a finite element golf ball model including a large number of elements through mesh formation such that a ratio of hexahedron elements to all the elements is 95% or more; and (I) analyzing the physical property of the golf ball through a finite element method using the finite element golf ball model obtained at the step (H).

2. A method of manufacturing a golf ball in which a specification of the golf ball is determined based on information obtained by a method of analyzing a physical property of the golf ball comprising the following steps and the golf ball is manufactured based on the specification, the analyzing method comprising the steps of:

(H) obtaining a finite element golf ball model including a large number of elements through mesh formation such that a ratio of hexahedron elements to all the elements is 95% or more; and (I) analyzing the physical property of the golf ball through a finite element method using the finite element golf ball model obtained at the step (H).

3. A method of analyzing a physical property of a golf ball according claim 1, wherein the large number of elements is in a range of from 864 to 100,000.

4. A method of manufacturing a golf ball according to claim 2, wherein the large number of elements is in a range of from 864 to 100,000.

* * * * *